US009771778B2

(12) United States Patent
O'Connor

(10) Patent No.: US 9,771,778 B2
(45) Date of Patent: Sep. 26, 2017

(54) MAGNETIC SWITCH AND USES THEREOF IN WELLBORES

(71) Applicant: Keven O'Connor, Houston, TX (US)

(72) Inventor: Keven O'Connor, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 799 days.

(21) Appl. No.: 14/254,408

(22) Filed: Apr. 16, 2014

(65) Prior Publication Data

US 2015/0300097 A1 Oct. 22, 2015

(51) Int. Cl.

*E21B 41/00* (2006.01)
*H01H 1/06* (2006.01)
*H01H 36/00* (2006.01)

(52) U.S. Cl.

CPC ..... *E21B 41/00* (2013.01); *H01H 1/065* (2013.01); *H01H 2036/0086* (2013.01)

(58) Field of Classification Search

CPC .... E21B 41/00; E21B 47/0905; E21B 47/122; E21B 17/003; H01H 36/00; H01H 35/02; H01H 1/16; H01H 1/065; H01H 2036/0086; Y10S 200/29

USPC ..... 166/66.5; 335/280

See application file for complete search history.

(56) References Cited

U.S. PATENT DOCUMENTS 2,015,156 A * 9/1935 Richmond ..... H01H 1/065 335/280
2,917,599 A * 12/1959 Ovshinsky ..... H01H 1/065 335/1
2,999,914 A 9/1961 Stanaway
3,152,230 A 10/1964 Richartz
3,200,216 A * 8/1965 Deutschman ..... H01H 1/065 335/179
4,004,261 A * 1/1977 Klingenberg ..... H01H 3/00 335/280
4,333,066 A * 6/1982 Roach ..... H01H 1/065 335/206
5,006,676 A * 4/1991 Bogut ..... H01H 35/14 200/61.52
5,209,343 A * 5/1993 Romano ..... H01H 35/02 200/61.45 R
6,005,205 A * 12/1999 Chou ..... H01H 35/02 200/61.45 M
7,291,794 B2 * 11/2007 Woods ..... H01H 36/00 200/61.62
7,768,367 B2 8/2010 Chen et al.
2016/0040507 A1 * 2/2016 Donderici ..... E21B 41/00 166/255.1
2016/0047204 A1 * 2/2016 Donderici ..... E21B 33/12 166/381

* cited by examiner

*Primary Examiner* — Michael Wills, III

(74) *Attorney, Agent, or Firm* — Cantor Colburn LLP

(57) ABSTRACT

In one aspect, an apparatus for use in a wellbore is disclosed that in one non-limiting embodiment includes a string for placement in the wellbore and a switch on an outside of the string, wherein the switch includes a plurality of magnetic elements that provide a continuous electrical when the plurality of magnetic elements are aligned by an externally applied magnetic field. In one embodiment, the switch includes a channel that houses the plurality of magnetic elements that remain unaligned until the magnetic elements are aligned by the externally applied magnetic field.

21 Claims, 3 Drawing Sheets

MAGNETIC SWITCH AND USES THEREOF IN WELLBORES

BACKGROUND

1. Field of the Disclosure

This disclosure relates generally to a magnetic switch and use of such a switch in wellbore applications.

2. Background of the Art

Wellbores are drilled in subsurface formations for the production of hydrocarbons (oil and gas). Modern wells can extend to great well depths, often more than 15,000 ft. Hydrocarbons are trapped in various traps or zones in the subsurface formations at different wellbore depths. Such zones are referred to as reservoirs or hydrocarbon-bearing formations or production zones. A casing is generally placed inside the wellbore and the space between the casing and the wellbore (annulus) is filled with cement. A production string or assembly containing a number of devices is placed inside the casing to perform a variety of operations downhole, including, but not limited to, fracturing, treatment and production of fluids from the formation to the surface. The downhole devices may include, valves, such as sliding sleeve valves, packers, sensors, etc., which devices may be installed on an outside of a tubular in the string. It is desirable to provide a device, such as a switch, on the outside of a tubular that may be activated from inside the tubular to operate one or more devices placed on the outside of tubular.

The disclosure herein provides a switch that may be mounted on an outside of a tubular, such as a string that may be switched or activated from one position to another from inside of the tubular to perform an operation in the wellbore, including operating a device mounted on the outside of the tubular.

SUMMARY

In one aspect, an apparatus for use in a wellbore is disclosed that in one non-limiting embodiment includes a string for placement in the wellbore and a switch on an outside of the string, wherein the switch includes a plurality of magnetic elements that provide a continuous electrical path or connection when the plurality of magnetic elements are aligned by an externally applied magnetic field. The switch with aligned magnetic element is also referred to herein as "activated" and with the magnetic elements unaligned as "deactivated". In one embodiment, the switch includes a channel that houses the plurality of magnetic elements that remain unaligned until the magnetic elements are aligned by the externally applied magnetic field.

In another aspect, a method of providing an electrical connection outside a string in a wellbore is disclosed, which method in one non-limiting embodiment includes: providing a string for placement in the wellbore; and placing at least one switch on an outside of the string, wherein the at least one switch includes a plurality of magnetic elements that provide a continuous electrical connection or path when the plurality of magnetic elements are aligned by an external magnetic field. In another aspect, the method may further include: placing the string in the wellbore; and aligning the plurality of magnetic elements in the at least one switch (i.e., activating the switch) by the external magnetic field to provide the continuous electrical connection.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
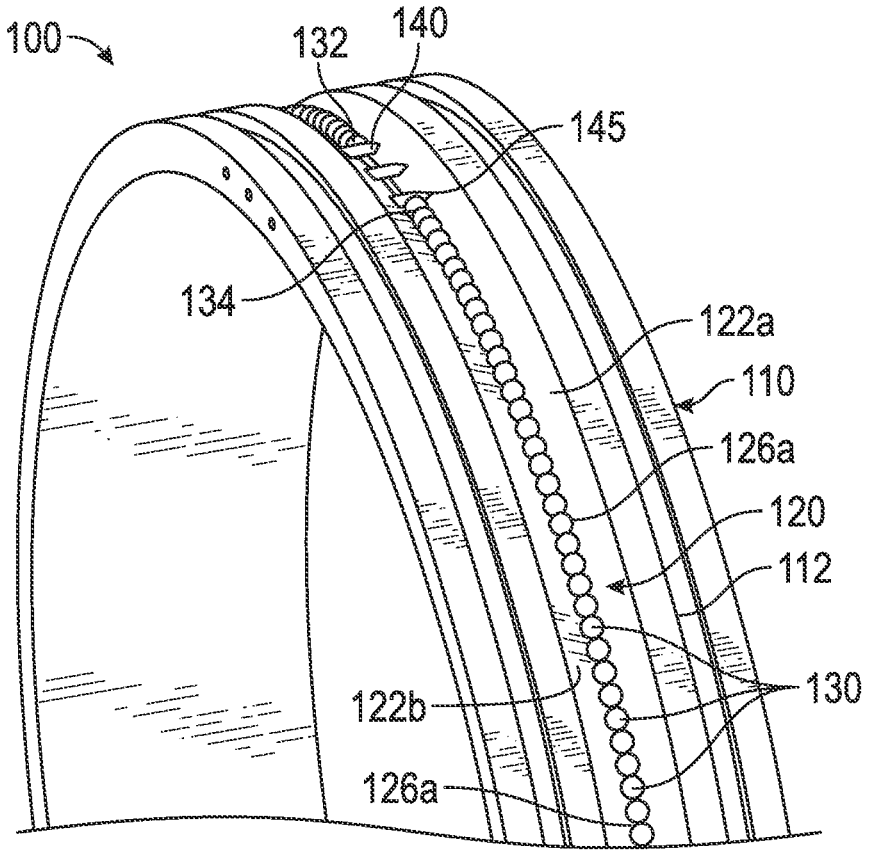
FIG. 1 shows an exemplary partial isometric view of a non-limiting embodiment of a magnetic switch, made according to one embodiment of the disclosure.

FIG. 1 shows an exemplary partial isometric view of a non-limiting embodiment of a magnetic switch 100, made according to one embodiment of the disclosure. In one non-limiting embodiment, the switch 100 may be made in the form of a circular member, such as ring 110, for placement around an outside of a tubular, such as a casing or another tubular, used in wellbores. In one configuration, the switch 100 may include a center groove, such as channel or groove 120, around the outer periphery 112 of the ring 110. The groove 120 may include a bottom 126*a* and a top 126*b* and slant or inclined sides 122*a* and 122*b* that terminate at the bottom 126*a* of the groove 120. The groove 120 may be a v-groove or a u-groove or have any other shape suitable for the purposes described herein. Channel 120 may be lined with an electrically insulating material. In one aspect, the groove 120 may be lined with magnetic balls or beads 130, which balls may be of the same size or different size. The magnetic balls 130 may be made from any suitable magnetic material, such as a ferrous material. The groove 120 includes terminals or connections 140 and 145. The size and number of balls 130 are selected so that when the balls 130 align or line up along the bottom or center 126*a* of the groove 120, the end ball 132 closest to the terminal 140 would contact the terminal 140 and the other end ball 134 closest to the terminal 145 would contact the terminal 145 and the remaining balls would be in serial contact with their adjoining balls so as to form a continuous electrical path or connection between the terminals 140 and 145. In such a state, terminals 140 and 145 may be utilized as the two terminals of a switch.

Figure 2:
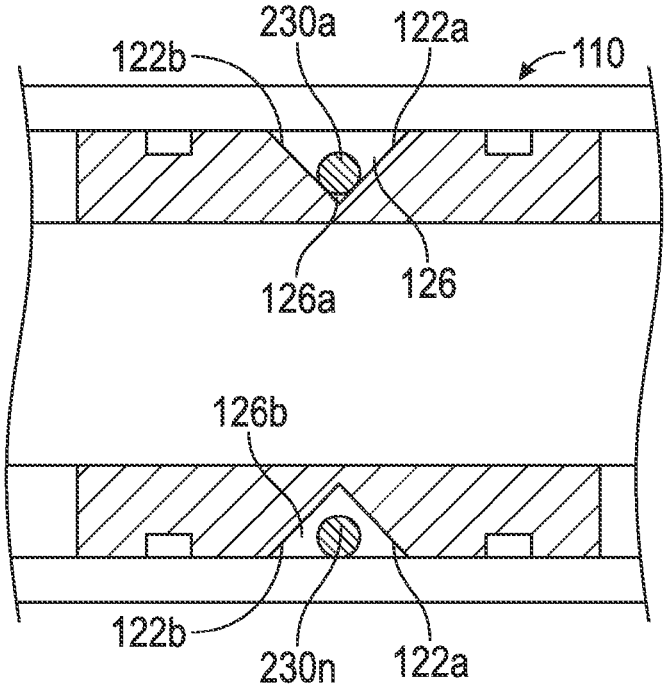
FIG. 2 is a partial view of a groove in the switch shown in FIG. 1 when the switch is in a vertical plane, such as when the switch is placed around a tubular in a horizontal wellbore.

FIG. 2 is a sectional view of the ring 110 when the ring is in vertical position or plane, such as when the ring is placed outside a horizontal pipe. In this vertical position or plane, some of the balls may stay at the bottom 126*a* of the grove 120, such as ball 230*a*, and some others will drop down to the top 126*b* of the groove 120, such as ball 230*n*. In this configuration, the balls are not aligned and thus do not form a continuous connection or link between terminals 140 and 145. The switch is open or is deactivated.

Figure 3:
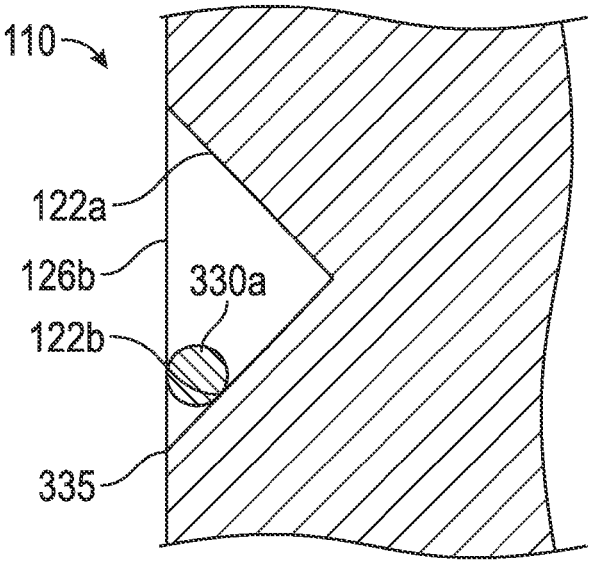
FIG. 3 is a partial view of the channel or groove of the switch shown in FIG. 1 when the switch is in a horizontal plane, such as when the switch is placed around a tubular in a vertical wellbore.

FIG. 3 is a partial sectional view of the ring 110 when the ring is in horizontal position or plane, such as when the ring is placed outside a vertical pipe. In this state, the groove 120 is in a horizontal plane. The position of the groove 120 shown in FIG. 2 is the position in which the ring 110 is turned 90 degrees counter-clockwise. In this position, all the balls will drop to the lowermost end of the groove 120, i.e., at the intersection 335 of the inclined side 122*b* and the top side 126*b*, as shown by the ball 330*a*. In the position shown in FIG. 3, since the periphery formed by the end 335 is greater than the bottom of the groove 120, the diameter formed by the lowermost section will be greater than that of the groove and thus all balls will not be in contact with each other, thereby not making a continuous connection. In this state, the switch 100 will act as an open switch or deactivated. Similarly, in any other position between the positions shown in FIGS. 2 and 3, some of the balls will not be in the center of the groove, thereby not making a continuous electrical connection between terminals 140 and 145 and thus causing the ring 110 to act as an open switch. Referring to FIGS. 1-3, to form a continuous connection between the terminals 140 and 145, a magnetic field (or force) may be applied from inside the ring 110 toward the outer periphery of the ring to align the balls 130 in the center 126*a* of the groove 120, as shown in FIG. 1. As long as sufficient external magnetic field is applied to the magnetic elements, they remain aligned and become unaligned when such magnetic field is removed or reduced to an insufficient level. Thus, in aspects, the ring acts as a closed switch as long as the magnetic field is applied and acts as an open switch when the magnetic field is removed or reduced to an insufficient level. When the switch 100 is disposed in a wellbore, a tool containing one or more magnets may be run in the wellbore and positioned inside the ring 110 to cause the balls 130 to align in the groove 120 as described in more detail in reference to FIGS. 4-6.

Figure 4:
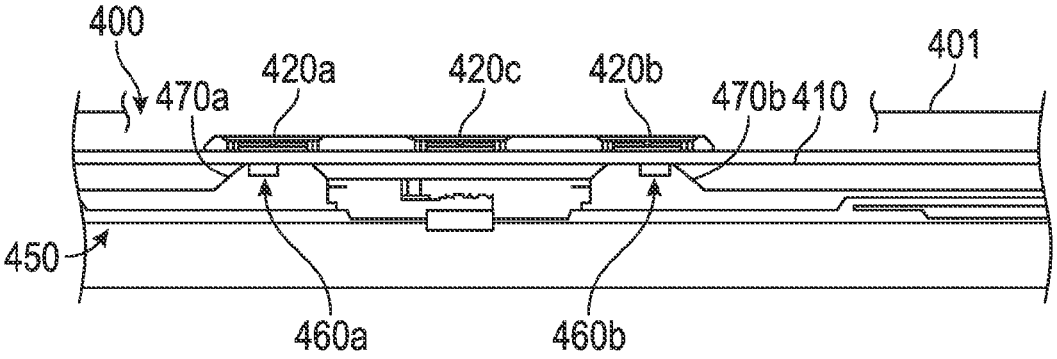
FIG. 4 shows three switches axially spaced apart around a tubular in a wellbore that will provide a closed circuit when two of the three switches are activated by a running tool containing a pair of magnets.

FIG. 4 shows a wellbore system 400 formed in a formation 401 utilizing three switches 420*a*, 420*b* and 420*c*, made according to one embodiment of the present disclosure, on an outside of a string 410 to operate or activate another device in the system 400. Although a single switch may be utilized, use of three switches can avoid accidental activation (closing) of the switch as described below in reference to FIGS. 4-6. Referring back to FIG. 4, switches 420*a*, 420*b* and 420*c* are disposed spaced apart on the string 410 as part of an electrical circuit described later. As discussed in reference to FIGS. 1-3, each switch is normally in an inactive or closed state or position and further since the balls in each switch are magnetic balls, they can be aligned magnetically. In one aspect, a running tool or service tool 450 may be used to convey magnets to activate and deactivate switches as desired. FIG. 6 shows an exemplary electrical circuit 600 that may be employed to provide a power output when a certain combination of switches is activated to avoid or reduce the chance of accidental activation. In one aspect, switches 420*a* and 420*b* are connected in series, while switch 420*c* is in parallel with the switches 420*a* and 420*b*. An electrical device 610 and a resistor 620 are provided in series with switch 420*c*, while another resistor 640 is provided between device 610 and switch 420*b*. An input voltage $V_{in}$ may be applied between the switch 420*a* and the device 610 by a source, such as a battery. In circuit 600, the device 610 is normally closed. When switches 420*a* and 420*b* are closed (activated), as shown by arrows 422*a* and 422*b* respectively and switch 420*c* is open (deactivated), the circuit 600 is closed and thus the resistor 640 will provide an output voltage $V_{out}$ at terminals 650*a* and 650*b*, which output may be utilized to activate a suitable device downhole.

Still referring to FIGS. 4 and 6, the running tool 450 may include a magnet 460*a* on a collet 470*a* and another magnet 460*b* on a collet 470*b*. In one aspect, each collet may include a number of fingers, wherein some or all fingers may include magnets so that as a whole, the magnets on a collet provide sufficient magnetic field to align the magnetic elements in a switch as described in reference to FIG. 1. The magnets 460*a* and 460*b* may be spaced so that when the tool 450 is run inside the string 410, the magnets 460*a* and 460*b* will respectively align with the switches 420*a* and 420*b*, as shown in FIG. 4. When the tool 450 is run in the string 410, magnet 460*b* will activate switch 420*a* when it is in front of the switch 420*a*. When magnet 460*b* moves past switch 420*a* and comes in front of switch 420*c*, switch 420*a* is deactivated and switch 420*c* activated. When tool 450 moves further down, magnet 460*a* will be in front of switch 420*b*, magnet 460*a* will be in front of switch 420*a* and no magnet will be in front of switch 420*c*, as shown in FIG. 4. In this position, switch 420*a* and 420*b* will be activated while switch 420*c* will be deactivated, thereby closing the circuit 600 and thus providing the output voltage $V_{out}$ at terminals 650*a* and 650*b*. The output $V_{out}$ may be utilized to operate any electrical device downhole. The exemplary configuration of circuit 600 provides a method of operating a switch placed on an outside of a member, such as a tubular, by a device from inside the member.

Figure 5:
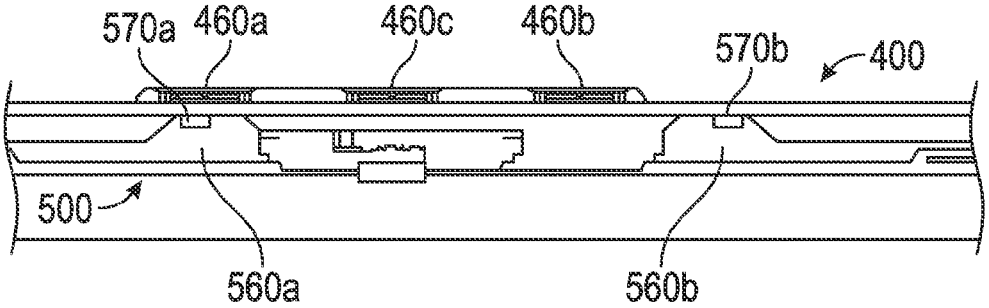
FIG. 5 shows three switches axially spaced as shown in FIG. 4, wherein the running tool is configured to pass through the three switches without activating two of the three switches at the same time.
Figure 6:
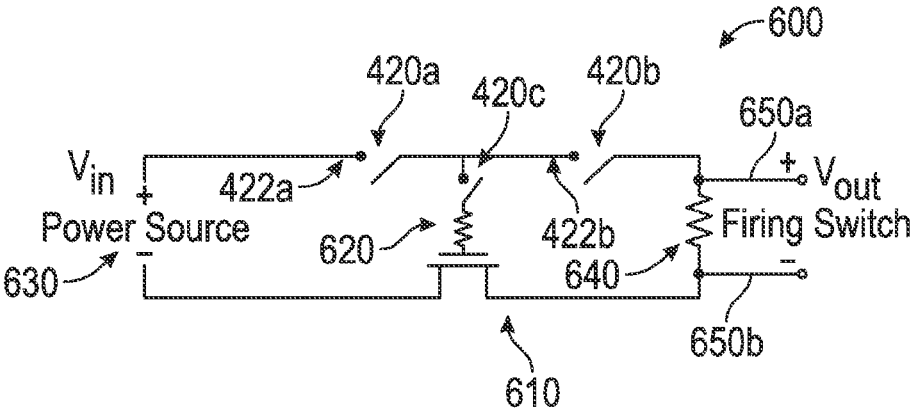
FIG. 6 shows a circuit corresponding to three switches shown in FIG. 4, wherein when two of the three switches are activated the third switch is deactivated at the same time will cause the circuit to provide an electrical output.

FIG. 5, show a running tool 500 in the wellbore system 400, wherein the running tool includes a magnet 560*a* on a collet 570*a* and another magnet 560*b* on a collet 570*b*. In the running tool 500, the collet 570*b* and thus the magnet 560*b* may be shifted or moved away from or close to the collet 570*a* so that the distance between the collets 570*a* and 570*b* is greater or less than the distance between switches 460*a* and 460*b*. In such a case, the magnets 560*a* and 560*b* will not align with switches 460*a* and 460*b* at the same time and thus will not activate both switches 460*a* and 460*b* at the same time when the tool 500 is run into the wellbore. FIG. 5 shows magnet 560*b* shifted away from magnet 560*a*. When the tool 500 is in position as shown in FIG. 5, the collet 570*b* may be shifted back so as to align the magnet 560*b* with the switch 460*b*, thereby activating both switches 460*a* and 460*b* at the same time as shown in FIG. 4.

Thus, in one aspect, a magnetic switch may be disposed on an outside of a member and activated from inside the member. The switch, in one aspect, may include a number of magnetic elements that can be aligned by providing a magnetic field or force inside the member to provide a continuous electrical connection. One or more such switches may be utilized to close a circuit to provide electrical energy for use in an intended application, such as operating a device or performing another operation.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a string for placement in the wellbore; and at least one switch on an outside of the string, the switch including a ring having a circumferential channel on its outer periphery and a plurality of magnetic elements within the channel that provide a continuous electrical connection when the plurality of magnetic elements are aligned along a center of a channel by a magnetic field.

2. The apparatus of claim 1, wherein the channel houses the plurality of magnetic elements and electrical terminals, wherein aligned plurality of magnetic elements in the center of the channel form the continuous electrical connection between the electrical terminals.

3. The apparatus of claim 2, wherein the plurality of magnetic elements align when the magnetic field is applied to the plurality of magnetic elements and unalign when the magnetic field is removed or reduced to an insufficient level.

4. The apparatus of claim 3, wherein the channel is selected from a group consisting of: a v-channel with a cover; and a u-channel with a cover.

5. The apparatus of claim 1 further comprising a running tool configured to be conveyed inside the string, the running tool including at least one magnet configured to align the plurality of magnetic element to provide the continuous electrical connection.

6. The apparatus of claim 5, wherein:

the at least one switch includes at least three spaced apart switches, wherein each such switch includes a plurality of magnetic elements that when are aligned provide a continuous electrical connection; and the running tool includes at least two spaced apart magnets wherein one of such magnets is positioned to align the magnetic elements of one of the switches and the other of such magnets is positioned to align the magnetic elements of another of the switches at the same time.

7. The apparatus of claim 1 further comprising a circuit coupled to the at least one switch that provides an electrical output when the magnetic elements of the at least one switch are aligned.

8. The apparatus of claim 6, wherein the circuit is coupled to the at least three switches and wherein the circuit provides an electrical output when magnetic elements of two of the three switches are aligned and the magnetic elements of the third switch are unaligned.

9. The apparatus of claim 7 further comprising at least one device that is operated in the wellbore when the at least one switch provides the electrical output.

10. A magnetic switch comprising:

a circular member having a groove formed around its outer periphery; and a plurality of magnetic elements that are unaligned until aligned into a bottom of the groove by an external magnetic field, wherein the aligned magnetic elements provide a continuous electrical connection.

11. The switch of claim 10, wherein the switch further comprises a ring that includes the groove and connection members in the groove at ends of the continuous electrical connection.

12. The switch of claim 11, wherein the groove is lined with an electrically insulating material and wherein the groove is selected from a group consisting of: a v-groove; and a u-groove.

13. The apparatus of claim 12, wherein the groove includes a cover to contain the plurality of magnetic elements with the groove.

14. A method of providing an electrical connection in a wellbore, comprising:

providing a string for placement in the wellbore; and placing at least one switch on an outside of the string, the switch including a circular member having a channel formed around its outer periphery and a plurality of magnetic elements in the channel that provide a continuous electrical connection when the plurality of magnetic elements are aligned into a center of the channel by an external magnetic field.

15. The method of claim 14 further comprising:

placing the string in the wellbore; and aligning the plurality of magnetic elements in the at least one switch by the external magnetic field to provide the continuous electrical connection.

16. The method of claim 15, wherein aligning the plurality of magnetic elements comprises:

conveying inside the string a running tool that includes a magnet that provides sufficient magnetic field to align the magnetic elements; and aligning the plurality of magnetic elements in the at least one switch with the magnet to provide the continuous electrical connection.

17. The method of claim 14, wherein the at least one switch includes a ring with a channel that houses the plurality of magnetic elements, and wherein the plurality of magnetic elements align within the center of the channel when the external magnetic field is applied to the plurality of magnetic elements and wherein at least one of the plurality of magnetic elements falls away from the center of the channel when the external magnetic field is removed or reduced to an insufficient level.

18. The method of claim 14, wherein the at least one switch includes at least three spaced apart switches, wherein each such switch includes a plurality of magnetic elements that are unaligned until aligned by a magnetic field to provide a continuous electrical connection, the method further comprising:

conveying a running tool having at least two spaced apart magnets configured to align the magnetic elements of at least two switches at the same time.

19. The method of claim 18 further comprising:

providing a circuit that includes the at least three switches that is configured to provide an electrical output when magnetic elements of two of the three switches are aligned and the magnetic elements of the third switch are unaligned.

20. The method of claim 14 further comprising a circuit coupled to the at least one switch that provides an electrical output when the magnetic elements of the at least one switch are aligned.

21. The method of claim 20 further comprising operating a device utilizing the electrical output from the circuit.

* * * * *